United States Patent [19]

Nishimoto et al.

[11] Patent Number: 5,062,906

[45] Date of Patent: Nov. 5, 1991

[54] METHOD OF MAKING NON-ORIENTED ELECTRICAL STEEL SHEETS

[75] Inventors: Akihiko Nishimoto; Yoshihiro Hosoya; Kunikazu Tomita; Toshiaki Urabe; Masaharu Jitsukawa, all of Tokyo, Japan

[73] Assignee: NKK Corporation, Tokyo, Japan

[21] Appl. No.: 427,108

[22] PCT Filed: Mar. 7, 1989

[86] PCT No.: PCT/JP89/00242

§ 371 Date: Oct. 12, 1989

§ 102(e) Date: Oct. 12, 1989

[87] PCT Pub. No.: WO89/08721

PCT Pub. Date: Sep. 21, 1989

[30] Foreign Application Priority Data

Mar. 7, 1988 [JP] Japan ..... 63-51785

[51] Int. Cl.[5] ..... H01F 1/04

[52] U.S. Cl. ..... 148/111; 148/3; 148/110; 148/120

[58] Field of Search ..... 148/111, 3, 110, 120

[56] References Cited

U.S. PATENT DOCUMENTS 4,116,729 9/1978 Katoh et al. ..... 148/111

4,666,534 5/1987 Miyoshi et al. ..... 148/111

FOREIGN PATENT DOCUMENTS 2332 1/1978 Japan ..... 148/111

123825 7/1983 Japan ..... 148/111

136718 8/1983 Japan ..... 148/111

123715 7/1984 Japan ..... 148/111

127817 6/1986 Japan .

278227 12/1987 Japan .

*Primary Examiner*—Prince Willis, Jr.

*Assistant Examiner*—R. D. Flatter

*Attorney, Agent, or Firm*—Henry C. Nields

[57] ABSTRACT

The present invention is to produce non-oriented electrical steel sheet by a hot direct rolling. The slab is directly sent to the hot rolling without the brief soaking, whereby others than AlN inevitably precipitated check the precipitation of AlN, a roughing and a finish rolling are performed at determined reduction rates, and a delay time is taken between the roughing and the finish rolling, and besides a finish rolling is performed at not more than $Ar_3$ so that precipitating nuclei of AlN are effectively introduced into the steel, and uniform and coarse AlN precipitation is formed by a coiling at temperature of more than 700° C., thereby to enable to provide uniform and satisfied ferrite grain growth at the recrystallization annealing.

9 Claims, 3 Drawing Sheets

METHOD OF MAKING NON-ORIENTED ELECTRICAL STEEL SHEETS

TECHNICAL FIELD

This invention relates to a method of making non-oriented electrical steel sheets.

BACKGROUND OF THE INVENTION

As important factors of governing magnetic properties of electrical steel sheets, sizes and dispersing conditions of AlN and MnS precipitated in steels are taken up. This is why these precipitates themselves become to obstacles to movements of magnetic domain walls and deteriorate not only the magnetic flux density under a low magnetic field but also the iron loss, and in addition, they hinder grain growth during recrystallization annealing, and immature grain growth thereby of ferrite grains give bad influences to developments of recrystallization texture preferable to the magnetic properties.

It is known that coarser precipitates are preferable for the movements of the magnetic domain walls during magnetization. Based on such background, there has been disclosed prior art trying to provide the precipitations and coarsenings of AlN or MnS before the recrystallization annealing in the processes of making the electrical steel sheets. For example, Japanese Patent Laid-Open Specification 38814/74 checks di-solution of the coarse AlN during a slab soaking by lowering the soaking temperature thereof; Japanese Patent Laid-Open Specification 22,931/81 lowers amounts of S and O which precipitates as non-metallic inclusions; Japanese Patent Laid-Open Specification 8,409/80 controls formation of sulphides by addition of Ca or REM; Same 108,318/77, 41,219/79 and 123,825/83 coasen AlN by brief soaking in the slab before the hot rolling; and Same 76,422/79 utilizes selfannealing effect by coiling at super high temperature after hot rolling for coarsening AlN and accelerating growth of ferrite grain.

From a viewpoint of saving the energy in the process, it is advantageous to carry out a hot direct rolling from the continuous casting of a slab when performing the hot rolling. However, if depending upon this process, a problem occurs that the coarse precipitations of AlN and MnS are made insufficient, and for solving the problem, the slab is subjected to a brief soaking before the hot rolling.

However, although the soaking time is short, such a process which once transfers the slab into the heating and soaking furnaces, could not enjoy merits of saving energy brought about by the hot direct rolling, and further for providing precipitation of AlN, if the soaking time is short, the precipitation will be non-uniform at the inside and outside of the slab.

DISCLOSURE OF THE INVENTION

In view of these problems of the prior art, in the invention the slab is directly sent to the hot rolling without the brief soaking, whereby others than AlN inevitably precipitated check the precipitation of AlN, and a delay time is taken between the roughing and the finish rolling, the temperature of which is performed at not more than $Ar_3$, so that precipitating nuclei of AlN are effectively introduced into the steel, and uniform and coarse AlN precipitation is formed by a coiling at temperature of higher than 700° C., thereby to enable to provide uniform and satisfied ferrite grain growth during the recrystallization annealing.

That is, the invention comprises roughing a slab immediately after continuously casting thereof to thickness of more than 20mm at reduction rate of more than 10% without brief soaking at specified temperature range, said slab containing C: not more than 0.005 wt %, Si: 0.1 to 1.5 wt %, Mn: 0.1 to 1.0 wt %, P: 0.01 to 0.15 wt %, and S: not more than 0.005 wt %; having a time interval of more than 30 sec at temperature range where the surface temperature of the roughed bar is higher than 950° C. till a following finish rolling; performing a finish rolling at lower than $Ar_3$ and at reduction rate of more than 25% and coiling at temperature of higher than 700° C.

DETAILED DESCRIPTION OF THE INVENTION

In the invention, the roughing is performed on the slab immediately after continuously casting thereof to the thickness of more than 20 mm at the reduction rate of more than 10%, without brief soaking at specified temperature range, said slab containing C: not more than 0.005 wt %, Si: 0.1 to 1.5 wt %, Mn: 0.1 to 1.0 wt %, P: 0.01 to 0.15 wt % and S: not more than 0.005 wt %, and subsequently the finish rolling is performed after having the specified time interval (called as "waiting time" hereinafter).

The precipitating nuclei of AlN are introduced into the steel in the waiting time so as to rapidly provide the uniform and coarse AlN precipitation after the coiling.

The electrical steel sheets of low and middle grades have low contents of Si and Al, and fine textures by $\gamma$-$\alpha$ transformation and fine precipitation of AlN give bad influences on the magnetic properties of the low magnetic field and the iron loss. Above all, when the hot direct rolling is carried out for saving energy, it is difficult to coarse AlN in the slab and more difficult to improve the magnetic properties. Against such problems, the present invention has the above stated waiting time after the roughing, aiming at strain induced precipitation of AlN in phase.

The above roughing accelerates the introduction of the uniform dispersion of precipitating of AlN nuclei in a short period of time by the introduction of the strain and destruction of the solidified texture, for which the reduction rate of more than 10%, preferably more than 20%

Figure 1:
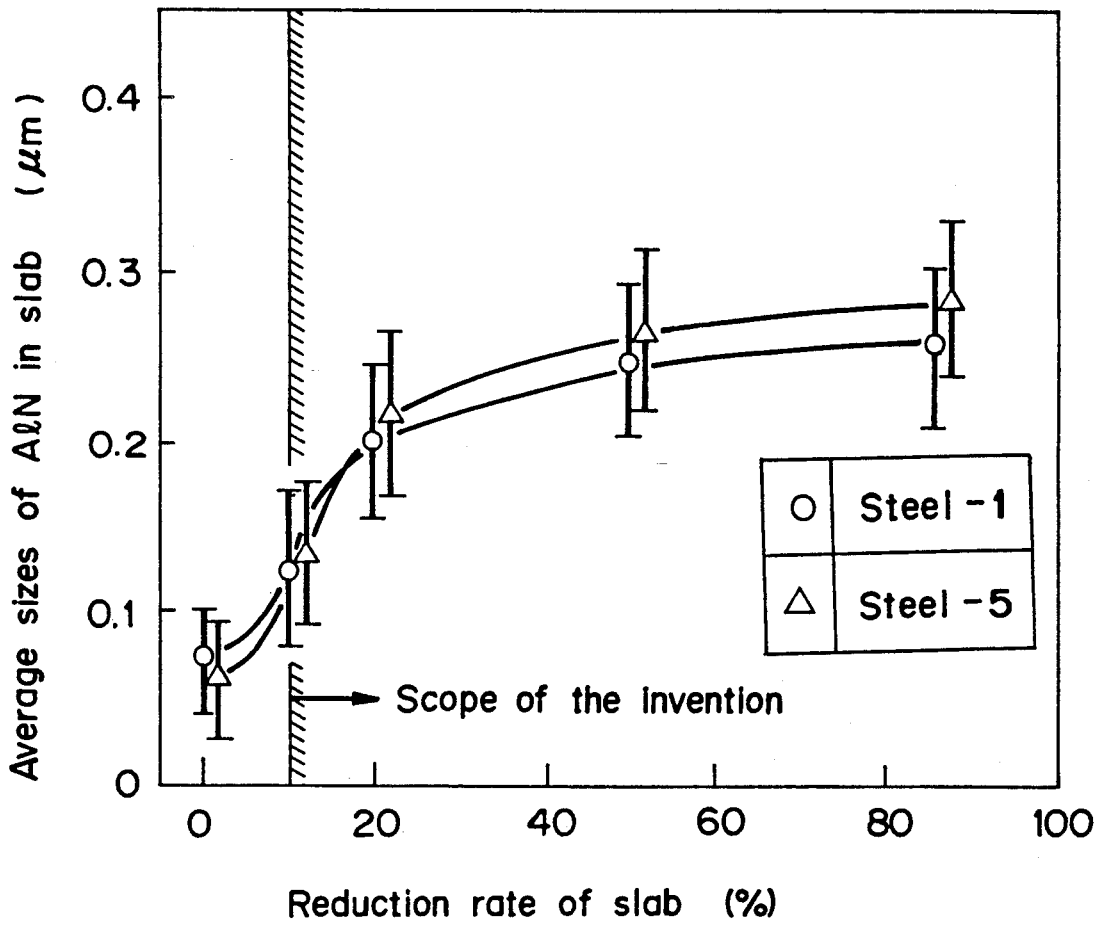
FIG. 1 shows influences of the roughing reduction rate on sizes of precipitating nuclei.

FIG. 1 takes up examples of 0.1% Si steel and 1% Si steel (Steels 1 and 5 of Table 1) for investigating influences of the reduction rate on average sizes of the precipitating nuclei of AlN in the slab, where the sample of 8.0 $\phi$mm$\times$12 lmm was heated for 20 minutes in the vacuum at the temperature by which AlN was perfectly molten, and rolled 0 to 87% at the temperature of 1050° C., and rapidly cooled by the gas, and the sizes of precipitating nuclei of AlN precipitated in the steel were measured, from which it is seen that if the reduction rate is less than 10%, the fine precipitation of AlN in the slab is a problem.

If the roughed bar has a too thin gauge, the cooling rapidly advances with an insufficient nucleation of AlN during the waiting period of time and it is difficult to not only provide the suitable precipitation but also secure the temperature of the finish rolling. Therefore, the thickness of the roughed bar should be 20 mm in the lower limit, preferably 30 mm.

During the waiting till the finish rolling after the roughing, the surface temperature of the roughed bar is kept higher than 950° C. for the purpose of securing the temperature of the finish rolling and usefully accelerating the nucleation of the precipitation nuclei of AlN at its precipitating nose.

Figure 2:
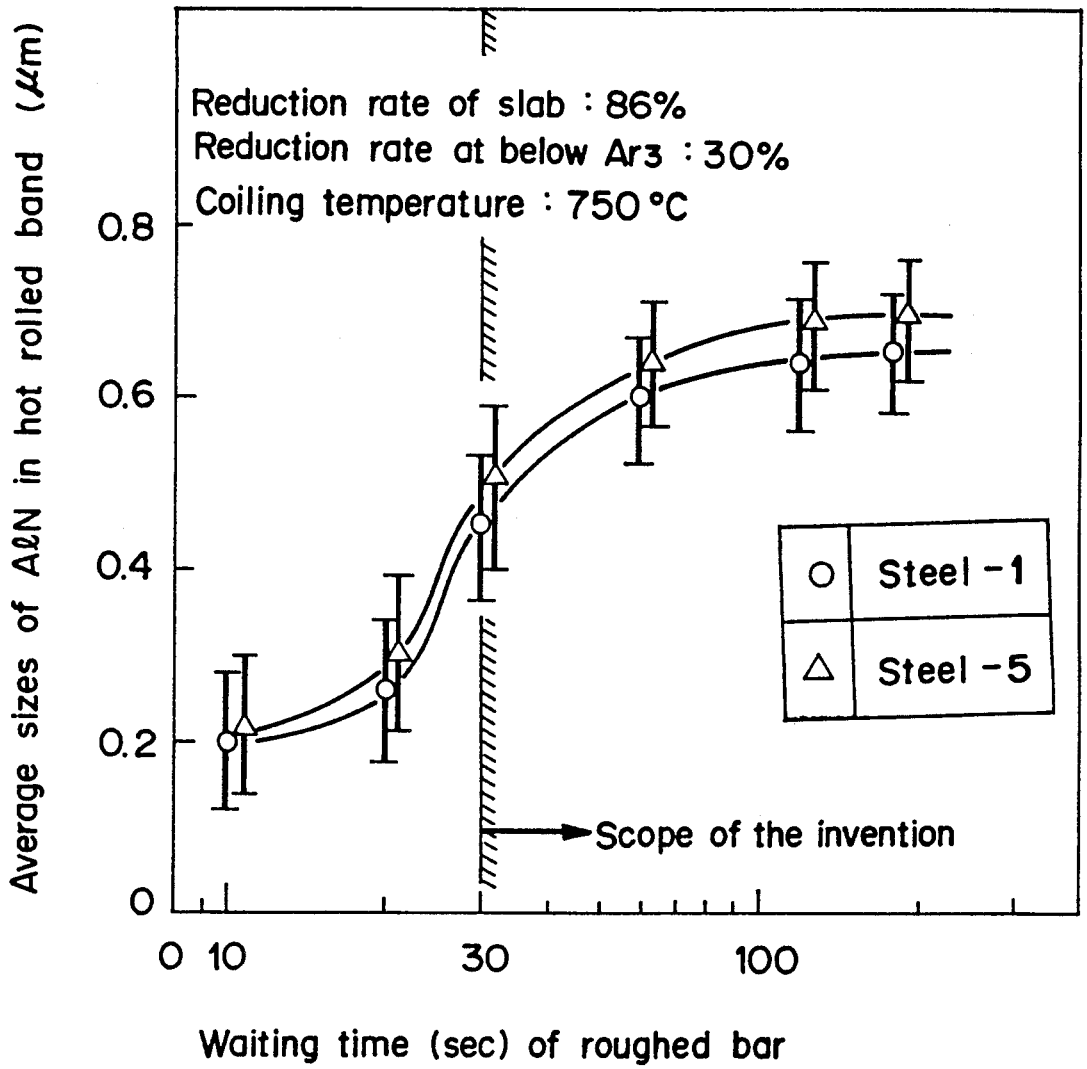
FIG. 2 shows influences of the waiting time of the roughed bar on sizes of the precipitating nuclei of AlN in the hot roller band.

The waiting time is determined more than 30 sec. FIG. 2 takes up examples of 0.1 and 1% silicon steels (Steel Nos. 1 and 5 of Table 1), and shows the influences of the waiting time (time from ending of the roughing to starting of the finish rolling) after the roughing on sizes of the precipitating nuclei of AlN in the hot rolled band. It is seen that the waiting time of more than 40 sec, preferably 60 sec should be secured for fully introducing the precipitating nuclei. On the other hand, if the waiting time is taken too much, the surface temperature of the roughed bar becomes lower than 950° C. and it will difficult to secure the finish rolling temperature and the coiling temperature of higher than 700° C. Thus, the waiting time should be determined not to lower the starting temperature of the finish rolling down 950° C. in response to the ending temperature of the roughing and the thickness of the roughed bar.

The waiting time herein designates a time until the starting temperature of the finish rolling from the ending of the roughing including the strip's normal running time and a delay time (an intentional waiting time). It will be assumed normally necessary to have the delay time for practising the present invention, but if the running time between the rollings satisfies the above waiting time the delay time is not necessary.

Further, it is possible to heat the edges of the roughed bar for compensating temperature thereat in the waiting time, whereby the invention may be effectively practised.

Figure 3:
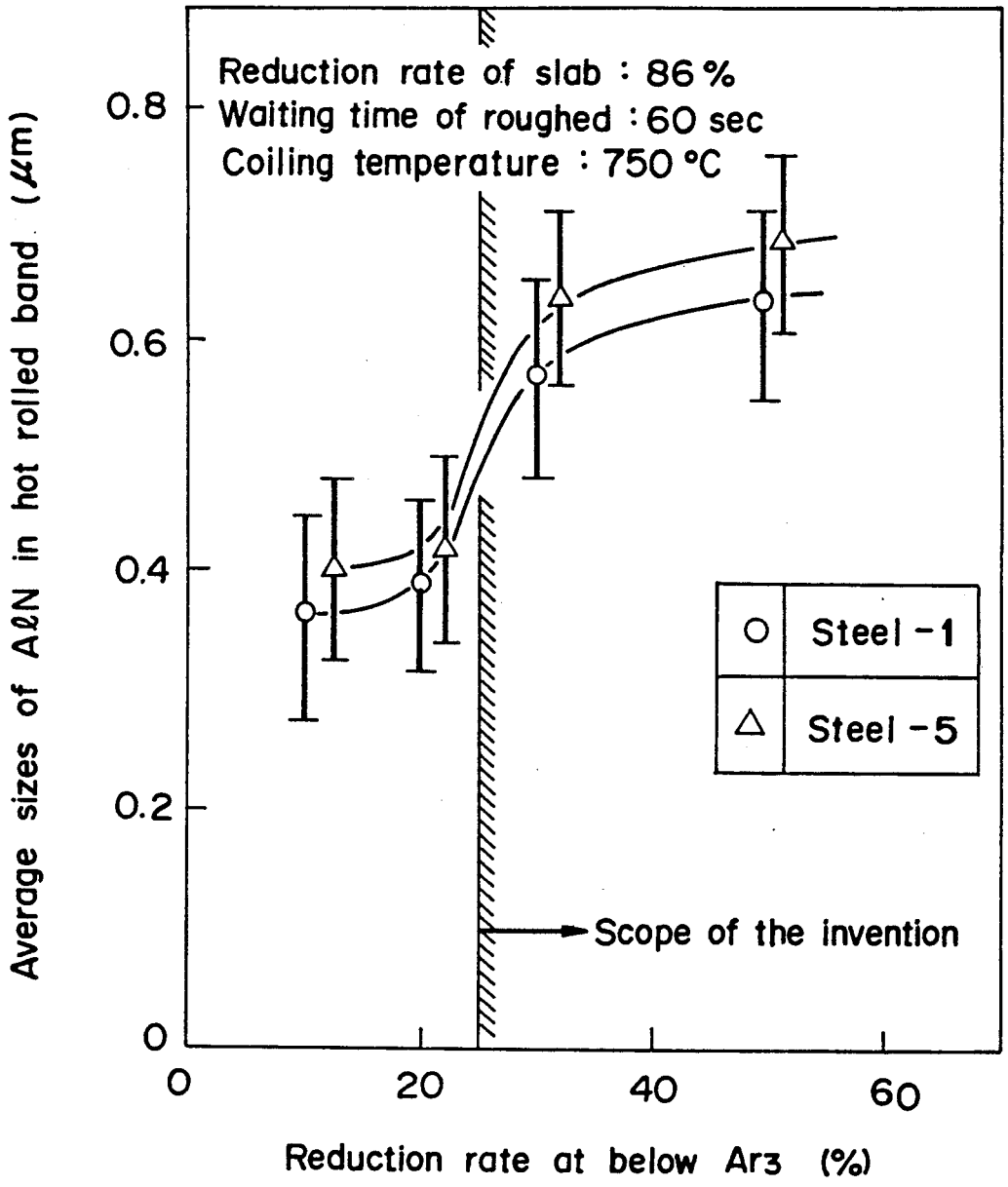
FIG. 3 shows influences of the reduction rate at lower than $Ar_3$ during finish rolling on sizes of precipitating sizes of AlN in the hot rolled band.

In the finish rolling, the reduction rate at lower than $Ar_3$ is more than 25%, preferably more than 30% in view of the introduction of the nuclei of Goss texture, aiming at the induction and growth of the strain of the precipitating nuclei of AlN, the uniformarization of the ferrite structure and the improvement of the magnetic flux density. FIG. 3 takes up examples of 0.1% Si steel and 1% Si steel for investigating influences of the reduction rate at lower than $Ar_3$ in the finish rolling on the average sizes of the precipitating nuclei of AlN in the hot rolled band, from which it is seen that the reduction rate of more than 25% (preferably more than 30%) should be secured for fully introducing the precipitating nuclei of AlN.

In the invention, AlN precipitated in the preceeding process is coarsened effectively and rapidly, for which the coiling is done at the temperature of more than 700° C. after the finish rolling.

The thus produced hot rolled band is normally subjected to the cold rollings of once or more than twice interposing the intermediate annealing, and finally to the annealing.

A next reference will be made to reasons for limiting the steel composition.

C is set not more than 0.005 wt % when producing steel slabs so as to secure the ferrite grain growth by lowering C during heating treatment of the hot rolled band and affect coarsening of AlN via decreasing of the solubility limit of the solute AlN accompanied with stabilization of ferrite phases.

Si has an upper limit of 1.5 wt % for keeping the level of the magnetic flux density to be required to electrical steel sheets of low and middle grades and since the present invention aims at steel sorts having $\gamma$-$\alpha$ transformation, and for lowering the iron loss value to be indispensable to the electrical steel sheets.

S is determined in its upper limit for improving the magnetic properties by decreasing an absolute amount of MnS. By setting not more than 0.005 wt %, bad influences of MnS in the hot direct rolling may be brought to a negligible level.

Al of not more than 0.001 wt % does not precipitate AlN, so that the effects of the invention may be fully displayed. Therefore, the upper limit is 0.001 wt % except that it is added intentionally. But when a slab is made by the continuously casting process, it should be added in the necessary amount aiming at lowering oxygen level in the steel and fixing nitrogen after the final annealing, and in this case its amount is 0.005 to 0.5 wt %. When adding Al intentionally, and if being less than 0.005 wt %, it is difficult to coarsen AlN satisfactorily, though depending on the present invention. The upper limit is determined to be 0.5 wt % for keeping the level of the magnetic flux density to be required to the low and middle grade materials.

Depending upon the present invention, it is possible to secure satisfactorily precipitation and coarsening of AlN in the hot rolling procedure and the ferrite grain growth, while performing the hot direct rolling. Therefore, it is possible to economically produce the non-oriented electrical steel sheet with excellent magnetic properties, by fully making use of the merits of the hot direct rolling.

EXAMPLE 1

The continuously cast slabs (Steels 1, 2, 4, 6 and 7) having the chemical compositions of Table 1 were passed through Hot Rolling - Annealing - Pickling - Cold Rolling - Final Continuous Annealing, and the non-oriented electrical steel sheets. The magnetic properties of the produced electrical steel sheets and the characteristics of the hot rolled bands are shown in Table 2 together with the hot rolling conditions.

TABLE 1

| Steel Sorts | | C | Si | Mn | P | S | Sol.Al | (wt %) N |
|---|---|---|---|---|---|---|---|---|
| 1 | Inv. S. | 0.0035 | 0.10 | 0.31 | 0.022 | 0.004 | 0.12 | 0.0019 |
| 2 | Com. S. | 0.0029 | 0.12 | 0.32 | 0.018 | 0.012 | 0.08 | 0.0021 |
| 3 | Inv. S. | 0.0030 | 0.32 | 0.25 | 0.013 | 0.004 | 0.008 | 0.0023 |
| 4 | " | 0.0032 | 0.45 | 0.21 | 0.012 | 0.004 | 0.007 | 0.0019 |
| 5 | " | 0.0040 | 1.17 | 0.22 | 0.008 | 0.003 | 0.15 | 0.0031 |
| 6 | Com. S. | 0.0036 | 1.42 | 0.20 | 0.011 | 0.011 | 0.32 | 0.0021 |
| 7 | Inv. S. | 0.0031 | 1.48 | 0.21 | 0.009 | 0.003 | 0.33 | 0.0020 |

Note
Inv. S.: Invention Steel
Com. S.: Comparative Steel

TABLE 2

| No. | A | Hot Rolling Conditions B (%) | C (mm) | D⁻ (sec) | E (°C.) | F (%) | G (°C.) | H (μm) | I $B_{50}$ (T) | $W_{15/50}$ (w/Kg) |
|---|---|---|---|---|---|---|---|---|---|---|
| 1 | Com. 1. | 78 | 48 | 30 | 1080 | 0 | 700 | 0.36 | 1.73 | 6.10 |
| | " | " | " | 20 | 1090 | 50 | " | 0.30 | 1.77 | 6.29 |
| | " | 86 | 30 | 60 | 1040 | 10 | 750 | 0.41 | 1.70 | 5.95 |
| | " | " | " | " | " | 30 | 650 | 0.27 | 1.69 | 6.52 |
| | Inv. P. | " | " | " | " | " | 750 | 0.59 | 1.79 | 5.70 |
| 4 | Com. P. | " | " | 20 | 1060 | 5 | 700 | 0.09 | 1.73 | 6.13 |
| | " | " | " | " | " | 50 | " | 0.15 | 1.75 | 5.95 |
| | " | " | " | 60 | 1040 | 5 | 750 | 0.20 | 1.71 | 5.88 |
| | Inv. P. | " | " | " | " | 50 | " | 0.32 | 1.75 | 5.42 |
| 7 | Com. P. | 78 | 48 | 20 | 1090 | 30 | 770 | 0.37 | 1.71 | 3.90 |
| | Inv. P. | " | " | 100 | 1050 | 50 | " | 0.75 | 1.72 | 3.25 |
| 2 | " | 86 | 30 | 60 | 1040 | 30 | 750 | 0.53 | 1.77 | 6.35 |
| 6 | " | " | " | 100 | 980 | 50 | 770 | 0.70 | 1.69 | 3.95 |

Note
Inv. P: Invention Process
Com. P: Comparison Process
A: Processes
B: Reduction rate of slab
C: Thickness of roughed bar
D: Waiting time
E: Starting temperature of finish rolling
F: Reduction rate at lower than $Ar_3$
G: Coiling temperature
H: AlN sizes in hot rolled bands
I: Magnetic properties after annealing

EXAMPLE 2

The continuously cast slabs (Steels 1, 3 and 5) having the chemical compositions of Table 1 were passed through Hot Rolling - Annealing - Pickling - Cold Rolling - Final Continuous Annealing, and the non-oriented electrical steel sheets. The magnetic properties of the produced electrical steel sheets and the characteristics of the hot rolled bands are shown in Table 3 together with the hot rolling conditions.

TABLE 3

| No. | Process | Hot rolling conditions: Slab reduction rate (%) | Waiting time | AlN sizes in hot rolled band (μm) | Magnetic properties after annealing: $B_{50}$ (T) | $W_{15/50}$ (w/Kg) |
|---|---|---|---|---|---|---|
| 1 | Com. p | 0 | 60 | 0.11 | 1.70 | 6.53 |
| | " | 20 | 20 | 0.23 | 1.72 | 6.10 |
| | Inv. p | 20 | 60 | 0.48 | 1.77 | 5.87 |
| 3 | Com. p | 0 | 20 | 0.05 | 1.70 | 6.13 |
| | " | 0 | 60 | 0.09 | 1.71 | 5.95 |
| | Inv. p | 50 | 60 | 0.29 | 1.74 | 5.67 |
| 5 | Com. p | 0 | 100 | 0.21 | 1.69 | 4.89 |
| | Inv. p | 20 | 100 | 0.49 | 1.72 | 4.10 |

Note
Slab thickness: 40 mm t (This gauge process)
Reduction at lower than $Ar_3$
Coiling temperature: No. 1 (700° C.), Nos. 3, 5 (750° C.)
Starting temperature of finish rolling: 1080–1000° C.

INDUSTRIAL APPLICABILITY

The present invention is applied to the production of non-oriented electrical steel sheets.

We claim:

1. A method of making non-oriented electrical steel sheets, comprising roughing a steel slab immediately after continuously casting thereof to thickness of more than 20 mm at reduction rate of more than 10% without brief soaking at specified temperature range, said steel slab containing C: not more than 0.005 wt %, Si: 0.1 to 1.5 wt %, Mn: 0.1 to 1.0 wt %, P: 0.01 to 0.15 wt %, N: not more than 0.0031 wt %, sol.Al: 0.005 to 0.5 wt %, and S: not more than 0.005 wt %; having a time interval of more than 30 sec at temperature range where the surface temperature of the roughed bar is more than 950° C. till a following finish rolling; performing a finish rolling at not more than $Ar_3$ and at reduction rate of more than 25 % and coiling at temperature of more than 700° C.

2. The method as claimed in claim 1, wherein the roughing is carried out at reduction rate of more than 20%.

3. The method as claimed in claim 1, wherein the finish rolling is carried out at reduction rate of more than 30%.

4. The method as claimed in claim 1, wherein edges of the roughed bar are heated at a period of transferring between the roughing and the finish rolling.

5. A method of making non-oriented electrical steel sheets, comprising roughing a steel slab immediately after continuously casting thereof to thickness of more than 20 mm at reduction rate of more than 20 % without brief soaking at specified temperature range, said steel slab containing C: not more than 0.005 wt %, Si: 0.1 to 1.5 wt %, Mn: 0.1 to 1.0 wt %, P: 0.01 to 0.15 wt %, N: not more than 0.0031 wt %, sol.Al: 0.005 to 0.5 wt %, and S: not more than 0.005 wt %; having a time interval of more than 30 sec at temperature range where the surface temperature of the roughed bar is more than 950° C. till a following finish rolling; performing a finish rolling at not more than $Ar_3$ and at reduction rate of more than 30% and coiling at temperature of more than 700° C.

6. The method as claimed in claim 5, wherein edges of the roughed bar are heated at a period of transferring between the roughing and the finish rolling.

7. The method as claimed in claim 5, wherein the roughing is carried out at reduction rate of more than 20%.

8. The method as claimed in claim 5, wherein the finish rolling carried out at reduction rate of more than 30%.

9. The method as claimed in claim 5, wherein edges of the roughed bar are heated at a period of transferring between the roughing and the finish rolling.

* * * * *